United States Patent [19]

Dominique et al.

[11] Patent Number: 4,747,744

[45] Date of Patent: May 31, 1988

[54] MAGNETIC DRIVE GEROTOR PUMP

[75] Inventors: Alexander L. Dominique, Cincinnati; David H. Voisard, Troy, both of Ohio

[73] Assignee: Eastman Kodak Company, Rochester, N.Y.

[21] Appl. No.: 1,774

[22] Filed: Jan. 9, 1987

[51] Int. Cl.[4] ..... F04B 35/00

[52] U.S. Cl. ..... 417/420; 418/171; 464/29

[58] Field of Search ..... 417/420; 418/171, 130, 418/131, 135; 464/29

[56] References Cited

U.S. PATENT DOCUMENTS

| | | | |
|---|---|---|---|
| 2,711,286 | 1/1955 | McAdam | 418/171 X |
| 3,083,894 | 4/1963 | Lück | 418/171 |
| 3,272,130 | 9/1966 | Mosbacher | 418/171 X |
| 4,013,384 | 3/1977 | Oikawa | 417/420 X |
| 4,095,426 | 6/1978 | Rhodes | 464/29 X |
| 4,115,040 | 9/1978 | Knorr | 464/29 X |
| 4,165,206 | 4/1979 | Martin et al. | 417/420 X |
| 4,526,518 | 7/1985 | Wiernicki | 417/420 |
| 4,540,347 | 9/1985 | Child | 418/135 |

*Primary Examiner*—Leonard E. Smith
*Assistant Examiner*—Eugene L. Szczecina, Jr.
*Attorney, Agent, or Firm*—John D. Husser

[57] ABSTRACT

A gerotor pump construction having a magnetic female gerotor member which is magnetically coupled to a drive source through a non-magnetic cap. The female gerotor element is configured with top and side wall portions which define the pump chamber so that friction is reduced at the top interface with the male gerotor.

12 Claims, 2 Drawing Sheets

MAGNETIC DRIVE GEROTOR PUMP

BACKGROUND OF THE INVENTION

1. Field of the Invention

The present invention relates to pumps which operate on the gerotor fluid displacement principle and more particularly to improved pump constructions for implementing this principle by means of magnetic coupling into a sealed pumping compartment.

2. Description of Prior Art

In order to isolate the handled fluid from the environment of the pump motor, a variety of pump configurations have been devised wherein there is a magnetic field coupling between a motor shaft and a drive shaft for the driven pump member. U.S. Pat. Nos. 2,970,548 and 2,996,994 are exemplary of concentric and axial approaches for such magnetic couplings. U.S. Pat. No. 4,526,518 discloses an application of the axial coupling approach to supply drive to the shaft of a male element of a gerotor pump.

As is described in the aforementioned '518 patent, gerotor pumps offer advantages as to pumping efficiency and low friction. Other advantages of such pumps include quietness in operation and self-priming modes of operation. While the '518 pump does successfully implement the magnetic drive of gerotor elements, it is relatively complex in construction and has a fairly large number of parts.

SUMMARY OF INVENTION

Thus, one significant purpose of the present invention is to provide structurally simplified configurations for effecting gerotor hydraulic transfer, with the advantages of magnetic drive coupling between the pump and its motor.

In addition to providing reduction in the number of component parts, and the concurrent simplifying of assembly, the present invention provides the advantages of reductions in part wear and reduction of bypass leakage. Further, the pump configurations of the present invention have advantageous pumping efficiency characteristics.

In one aspect, the present invention constitutes a magnetic drive, gerotor pump apparatus comprising: (a) a pump housing including (i) a gerotor bearing surface, (ii) inlet and outlet passages extending from housing inlet and outlets to spaced openings in the bearing surface and (iii) a hub portion extending normally to the bearing surface; (b) a male gerotor gear member having a central bore by which the gear member is located for rotation around the hub portion; (c) a female gerotor gear member mounted on the bearing surface in operative engagement with the male gerotor gear member, the female gear member comprising first magnetic means for producing a magnetic field external thereof; (d) a non-magnetic cap member covering the gerotor members; and (e) a magnetic driving member mounted for rotation proximate the cap member and comprising second magnetic means for producing a magnetic field that extends through the cap member to transmit rotation of driving member to the female gerotor gear member.

In one particularly preferred aspect, the female gerotor gear member comprises top and side wall portions which, together with the bearing surface, enclose the male gerotor gear member.

In other preferred aspects, the pump unit is constructed so that an operative force(s) urge the gerotor gear members into contact with the bearing surfaces of the pump base.

BRIEF DESCRIPTION OF DRAWINGS

The following description of preferred embodiments of the invention refers to the attached drawings wherein.

DETAILED DESCRIPTION OF PREFERRED EMBODIMENTS

Figure 1:
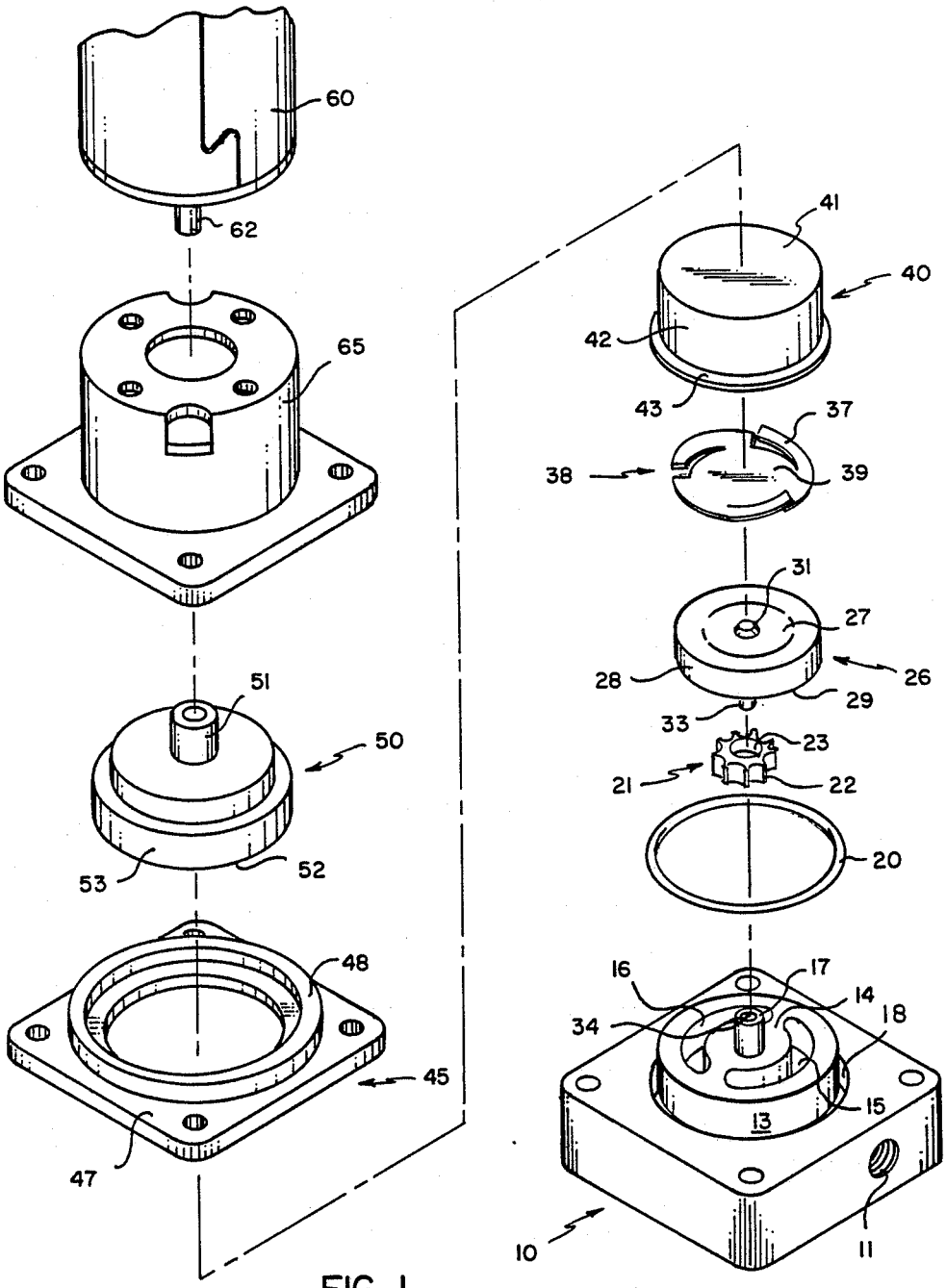
FIG. 1 is an exploded perspective view of one preferred embodiment of the present invention.

Referring to FIG. 1, there is shown a preferred embodiment of the present invention with component parts in a disassembled condition. Thus, the magnetic drive gerotor pump of FIG. 1 comprises a base member 10 which comprises a main body having a side outlet port 11 and a bottom inlet port (not shown in FIG. 1, but like that shown at 12 in FIG. 2). The pump body has a raised central portion 13 which has a top that provides a machined bearing surface 14 on which gerotor gear elements can rotate smoothly. The bearing surface 14 has arcuate slot openings 15 and 16 on opposite sides of a central hub 17. The slot opening 15 is connected by an outlet passage within the main body to the outlet port 11 and opening 16 similarly is connected by an inlet passage to inlet port 12. A circular recess 18 is provided around raised portion 13 to receive sealing ring 20.

A male gerotor member 21 comprises a gear toothed peripheral portion 22 and a central bore portion 23 that is adapted to fit rotatively around hub 17. The cooperative female gerotor tooth profile (not shown in FIG. 1, but like that shown in FIG. 3) is formed on the underside of female gerotor member 26. As shown, the member 26 comprises top and side wall portions 27, 28 and has a precision bottom surface 29 skirting the female gear profile and adapted to rotate smoothly on bearing surface 14. The member 26 also has a raised portion 31 formed on its top and a central axle portion 33 that extends normally to the gear plane and is adapted to rotate in bearing cavity 34 formed within hub 17. As shown in FIG. 1, and better illustrated in FIG. 2, the bearing cavity 34 is offset from the center of hub. 17. This offset is designed in accordance with known gerotor pump principles, and with the gear teeth profiles, so that during one complete revolution of the outer, female gerotor member, the inner, male member advances one tooth with respect to the outer member. That is, the inner member 21 has one less tooth than the outer member 26 and the advance of the one tooth per revolution advance of inner member provides a positive displacement pumping of fluid from the inlet slot 16 to the outlet slot 15. The detail design features of the gear profiles and axes offset are selected based on desired performance characteristics (e.g. available shaft speed, desire flow requirements, pressure and space constraints, etc) and can be selected in accordance with known design principles by one skilled in the art.

In another preferred embodiment, the axle portion 33 can be formed on, or attached to, the hub and the cooperative bearing cavity formed in the female gerotor element. The significant characteristic of either construction is that the female gerotor element be rotatably coupled to the hub for rotation on an axis offset from that of the male gerotor element.

A spring disc member 38 has a flat central portion 39 adapted to press on a flattened top surface of raised portion 31 of member 26 and flexible peripheral sectors 37 that are raised to resiliently engage the interior of top surface 41 of cap 40. Cap 40 also comprises a cylindrical side wall portion 42 and a flange portion 43 adapted to rest on sealing ring 20. Collar member 45 has a central opening 46 which fits over cap 40 and a mounting portion 47 for securing collar member 45 to base member 10 in a manner pressing flange 43 against seal 20. Collar member 45 also has a raised bearing surface 48 for supporting magnetic driving member 50.

Driving member 50 has a key top throat portion 51 and an interior bore 52 that is formed to receive the portion of cap 40 which extends above surface 48 of collar member 45. Driving member 50 further comprises a peripheral flange portion 53 which includes means for producing a magnetic field extending through the cap member 40 to transmit its rotation by magnetic attraction to female gerotor member 26. In this regard flange portion 53 is formed of a magnetizable material and at least the peripheral wall portion 28 of gerotor member 26 is similarly magnetizable. Both members are magnetized and cap 40 is formed of magnetically transmissive material so that magnetic field couples members 26 and 50. Thus, upon rotation of member 50 by motor 60, the female gerotor member 26 is rotatively driven to effect pumping operation of the gerotor elements. As shown, a housing 65 is provided to enclose the shaft 62 of motor 60 and the exterior of driven member 50.

Figure 2:
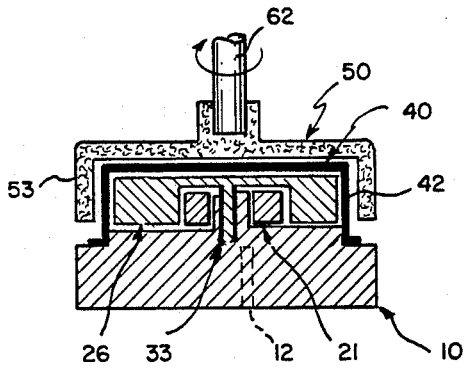
FIGS. 2 and 3 are cross-sectional views of a preferred embodiment of the present invention similar to the FIG. 1 embodiment.
Figure 3:
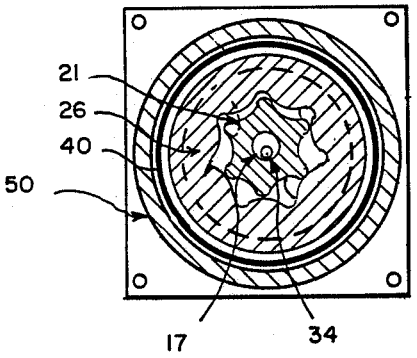

FIG. 2 is a simplified cross-sectional view showing the interrelations of the motor important operative members of the FIG. 1 apparatus. As can be seen, the rotation of shaft 62 will cause magnetic driving member 50 to rotate around the side walls 42 of cap 40. This rotative drive is transmitted magnetically through side walls 42 to effect attractive rotation of female gerotor member 26 on its axle 33, in bearing recess 34 of hub 17. Engagement of the gerotor gears transmits drive to male gerotor element 21 around hub 17, thus causing positive hydraulic displacement from inlet port 12 to outlet port 11 via the passages within base member 10 and slotted openings 15 and 16.

In order to achieve high pumping efficiency and low bypass leakage, it is desirable to force the top of female gerotor member downwardly toward base member 10. This force engages the bearing surfaces on the bottom of member 26 with the precision surface 14 on the base member and also causes engagement between the top surface of male gerotor member 21 and the opposing interior surface of the female gerotor element 26. Such engagements effectively seal the inlet slot 16 from the outlet slot 15 except through the pump cavities of the gerotor elements. Although such force causes engagement of gerotor surfaces, sliding contact between the facing surfaces is much less than in prior approaches because the female gerotor member forms the top wall of the pump chamber while rotating with the male gerotor member.

Figure 4:
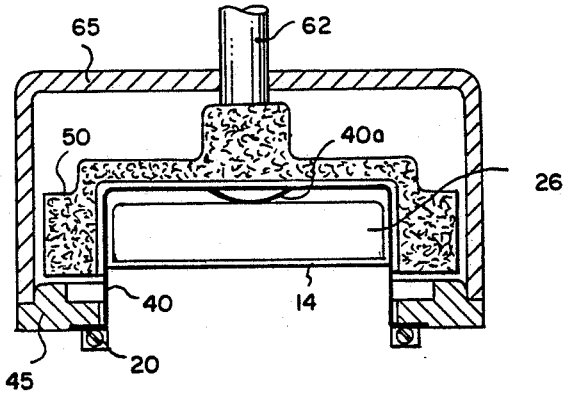
FIG. 4 is a partial cross-sectional view of another preferred embodiment of the present invention.

In accord with the present invention, there are several preferred approaches for attaining downward thrust upon the female gerotor member, which approaches can be utilized separately or in combination. In the FIG. 1 embodiment, this thrust is obtained by the action of spring member 39 between cap 40 and the raised portion 31 on member 26. In the FIG. 2 embodiment, this thrust is attained without a spring member by the passage of pumped liquid to the zone between the cap interior and the top of the female gerotor member. The resulting pressure differential between liquid above member 26 and the inlet passage 12 causes the desired downward thrust on member 26. The downward thrust can also be attained by designing the plane of symmetry of the cooperative magnetic fields in members 26 and 50 to be offset in a direction providing a downward magnetic force to member 26. FIG. 4 discloses a further alternative construction wherein downward force on member 26 is provided by a spherical protrusion **40*a* on the central portion of the interior top of cap 40**.

It will be appreciated that advantages of the present invention pertain to other configurations which employ features of the particularly described embodiments. For example, the driving magnetic coupling with the female gerotor member can be attained in an axially offset construction rather than the concentric mode. In such an embodiment the magnetic field producing means would produce fields through the top of cap member 40.

Also, in certain embodiments the axle bearing constraint for rotation of the female gerotor member can be replaced by a peripheral constraint provided, for example, by the cylindrical interior surface of the cap member 40. The female gerotor element can comprise an integral member which is molded containing magnetizable material and then selectively magnetized in the desired field configuration. Alternatively, the female georotor element can comprise a central gerotor gear portion which is press fit into a magnetizable housing disc structure that provides the top and side walls of the construction such as shown in FIG. 1.

The invention has been described in detail with particular reference to preferred embodiments thereof, but it will be understood that variations and modifications can be effected within the spirit and scope of the invention.

We claim:

1. A magnetic drive, gerotor pump apparatus comprising:

(a) a pump housing including (i) a gerotor bearing surface, (ii) inlet and outlet passages extending from housing inlet and outlets to spaced openings in said bearing surface and (iii) a hub portion extending normally to said bearing surface;

(b) a male gerotor gear member having a central bore by which said gear member is located for rotation around said hub portion;

(c) a female gerotor gear member mounted on said bearing surface in operative engagement with said male gerotor gear member, said female gear member comprising top and side wall portions which, together with said bearing surface, enclose said male gerotor gear member and which include first magnetic means for producing a magnetic field external thereof;

(d) a non-magnetic cap member covering said gerotor members; and (e) a magnetic driving member mounted for rotation proximate said cap member and comprising second magnetic means for producing a magnetic field that extends through said cap member to said first magnetic means of said female gerotor gear member.

2. The invention defined in claim 1 wherein said first magnetic means is located to produce magnetic fields extending from the periphery of said female gerotor gear member and said second magnetic means is formed in a flange of said driving member that extends around the side of said non-magnetic cap member.

3. The invention defined in claim 1 wherein sid female gerotor gear member is formed as a unitary element including an inner gear portion and an attached magnetic peripheral portion.

4. The invention defined in claim 1 wherein said female gerotor gear member is formed of magnetizable material.

5. The invention defined in claim 1 wherein the top of said cap member is spaced from the top wall of said female gerotor gear member and is sealingly attached to said pump base whereby liquid bypassing said outlet opening passes into the space between said cap member and the top wall of said gerotor gear member to urge said gerotor members into contact with said bearing surface of said pump base.

6. The invention defined in claim 1 or 5 further comprising spring means, located between said top wall portion of said female gerotor gear member and said cap, for urging said gerotor members into contact with the bearing surface of said pump base.

7. The invention defined in claim 1 or 5 wherein said cap member includes a generally spherical protrusion in the central portion of its top for urging said gerotor members into contact with the bearing surface of said pump base.

8. The invention defined in claim 2 wherein planes of magnetic symmetry of said first and second magnetic means are axially offset in a manner providing a magnetic thrust urging said gerotor members into contact with the bearing surface of said pump base.

9. The invention defined in claim 1 wherein said female gerotor gear member is rotatably coupled to said hub member for rotation on an axis normal to said bearing surface.

10. The invention defined in claim 9 wherein the axis of rotation of said female gerotor gear member is offset with respect to the axis of rotation defined by said hub and male gerotor member's bore.

11. The invention defined in claim 1 wherein said female gerotor gear member has a generally circular peripheral surface and said cap member includes a generally circular guide wall for constraining the path of rotation of said female gerotor gear member.

12. The invention defined in claim 1 wherein said inlet and outlet openings comprise arcuate slots formed in said bearing surface on opposing sides of said hub.

* * * * *